United States Patent [19]

Oxel

[11] Patent Number: 4,545,089

[45] Date of Patent: Oct. 8, 1985

[54] FLOOR CARE APPLIANCE WITH MOUNTED ACCESSORY APPLIANCE

[75] Inventor: Berton R. Oxel, Louisville, Ohio

[73] Assignee: The Hoover Company, North Canton, Ohio

[21] Appl. No.: 608,429

[22] Filed: Jun. 22, 1984

Related U.S. Application Data

[63] Continuation of Ser. No. 419,615, Sep. 17, 1982, abandoned.

[51] Int. Cl.[4] ..... A47L 9/00

[52] U.S. Cl. ..... 15/323; 15/339; 15/410

[58] Field of Search ..... 15/323, 327 C, 339, 15/344, 410

[56] References Cited

U.S. PATENT DOCUMENTS

| | | | |
|---|---|---|---|
| 2,779,047 | 1/1957 | Osborn | 15/323 |
| 2,854,686 | 10/1958 | Hansen . | |
| 3,020,577 | 2/1962 | Carabet . | |
| 3,284,834 | 11/1966 | Waters | 15/323 |
| 3,509,590 | 6/1970 | Koshiyama . | |
| 3,869,265 | 3/1975 | Wolter et al. | 15/323 |
| 4,209,875 | 7/1980 | Pugh et al. | 15/344 |
| 4,249,280 | 2/1981 | Goodrich | 15/339 |
| 4,467,493 | 8/1984 | Buchtel | 15/323 |

FOREIGN PATENT DOCUMENTS

| | | |
|---|---|---|
| 1523210 | 1/1967 | France . |
| 1052161 | 12/1966 | United Kingdom . |

*Primary Examiner*—Chris K. Moore
*Attorney, Agent, or Firm*—Gerald H. Kreske; Richardson B. Farley

[57] ABSTRACT

The invention includes a floor care appliance with a rigid housing having a pocket for nesting an accessory appliance. A latch means maintains the accessory appliance within the pocket and is releasable to permit removal of the accessory appliance.

7 Claims, 11 Drawing Figures

FLOOR CARE APPLIANCE WITH MOUNTED ACCESSORY APPLIANCE

This is a continuation of application Ser. No. 419,615, filed Sept. 17, 1982 and owned by a common assignee and now abandoned.

BACKGROUND OF THE INVENTION

1. Field of Invention

This invention relates to floor care appliances and, more particularly, relates to an upright cleaner having a pouch or pocket for the storage of an accessory appliance.

2. Description of the Prior Art

Tool storage in canister cleaners either within or on the canister casing is old and well known. Storage of tools on the handles of upright cleaners or the like is also known. But no one heretofore, to Applicant's knowledge, has advantageously provided an upright type floor care appliance having a nested accessory appliance mounted in a rigid housing of the floor care appliance.

Accordingly, it is an object of the invention to provide an upright type floor care appliance with accessory storage in a rigid housing of the floor care appliance.

It is an additional object of the invention to nest an accessory appliance in an upright type floor care appliance.

It is a further object of the invention to provide an upper rigid housing for a vacuum cleaner having a nesting receiving means for an accessory appliance.

It is a still further object of the invention to provide pocket means for the reception of a hand held appliance in a rigid housing of an upright vacuum cleaner.

SUMMARY OF THE INVENTION

The invention comprises an upright vacuum cleaner, floor care appliance or the like having a rigid housing in which is nested an accessory appliance. Specifically, the accessory appliance consists of a hand held cleaner which nests in a depression or pocket in an upwardly extending rigid housing disposed below the handle of a cleaner.

The pocket includes a front border portion behind which the snout or lower portions of the accessory appliance rests and an outwardly opening shell like portion to receive upper reaches of the accessory appliance above the lower portions of it.

A latching arrangement securely mounts the accessory appliance within the depression. In the preferred embodiment, this latching arrangement takes the form of a rectilinearly moving latch catch which engages in a slot on the inner side of the accessory appliance. In a second embodiment, the latch takes the form of at least a pair of spring finger catches which envelope the accessory appliance and engage with abutments on it.

BRIEF DESCRIPTION OF THE DRAWINGS

Reference now may be had to the accompanying Drawings for a better understanding of the invention, both as to its organization and function, with the illustration being of a preferred and a secondary embodiment, but being only exemplary, and in which.

DETAILED DESCRIPTION OF THE INVENTION

Figure 1:
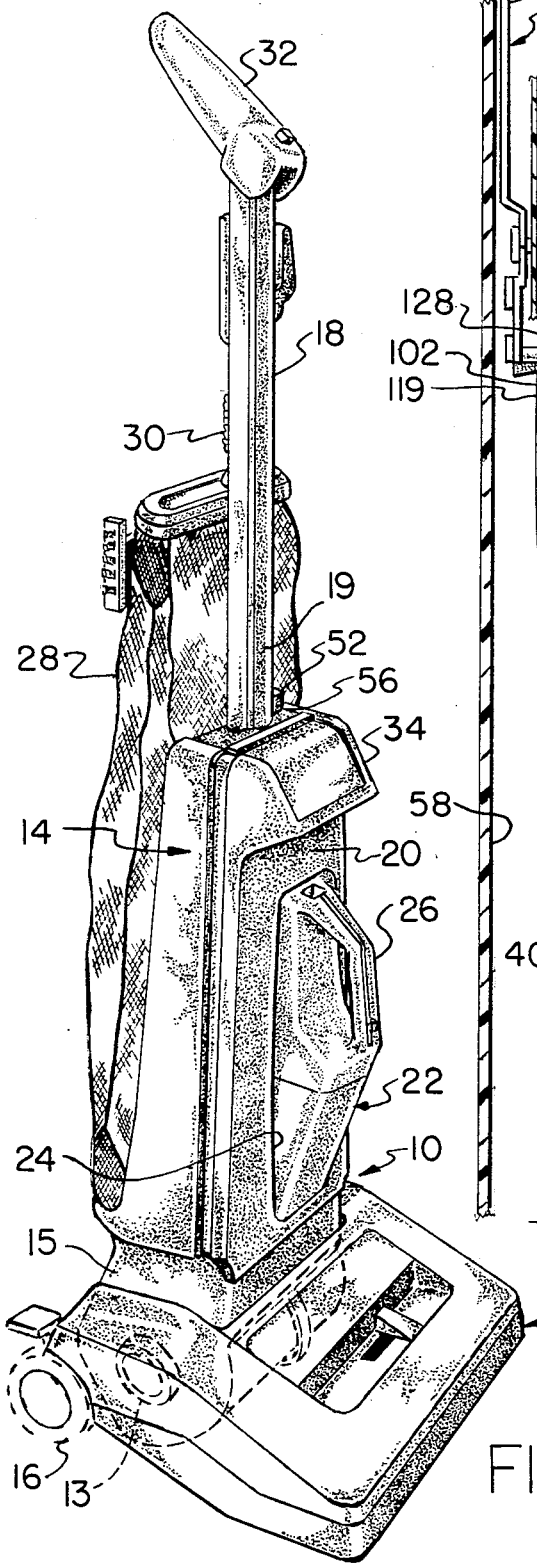
FIG. 1 is a perspective view of the preferred embodiment of the invention.

The invention (FIG. 1) comprehends a vacuum cleaner or floor care appliance 10 having a lower rigid housing 12 extending forwardly in an operational sense (operator related) extending forward in an operational sense (operator related) containing, conventionally, the suction nozzle (not shown) and an upper, upwardly extending rigid housing 14 having a bottom, conventionally, pivotally (pivot 13) attached to the lower rigid housing 12. The lower rigid housing includes wheels 16, while the upper rigid housing 14 is provided with a handle 18 having bottom reaches 19 attached to and extending upwardly from it.

Mounted within a front portion or cover 20 of the upper rigid housing 14 is an accessory cleaning appliance 22 which may ideally take the form of a hand held cleaner. Such a cleaner is generally disclosed in U.S. application Ser. No. 06/364,780, filed Apr. 2, 1982, titled, "Remote Switch Actuator" and owned by a common assignee. Reference should be had to this Application for a more particularized description of accessory appliance 22.

Accessory appliance 22 is lodged or nested in a pocket or depression 24 extending inwardly of the front portion or cover 20 of upper rigid housing 14 so that a portion of the accessory appliance 22 juts outwardly therefrom including a handle 26 of the accessory appliance 22.

The vacuum cleaner 10 also includes a bag 28 extending upwardly behind the upper rigid housing 14 and mounted at its upper end by a spring 30. A handgrip 32 is attached to the handle 26 at its upper end. A carrying handle 34 is also included in the upper rigid housing 14 in the front cover 20.

The accessory appliance 22 nests within the pocket or depression 24 and conforms closely to it because of the open shell like configuration of the pocket 24 which includes top wall 35, side walls 36 and 38 and back wall 40 which taper to conform to the taper of the accessory appliance 22 with the side walls 36 and 38 and back wall 40 curving inwardly at the thickest portion of the accessory appliance 22.

At the front, lower side of the pocket 24 is formed a thickened semi soft vinyl material portion 42 of the pocket 24 providing an upwardly opening generally V-shape 44 in which nests a snout 46 of the accessory appliance 22. A front portion 48 of thickened portion 42 is thereby formed to provide a wall obstructing the direct outward removal from the pocket 24 of the accessory appliance 22.

In order to maintain the accessory appliance 22 within the pocket 24 at its upper end, a plastic latching arrangement 50 is provided which engages with the accessory appliance 22. It includes a button 52 extending outwardly, for convenient operator access, from a top 56 of upper rigid housing 14.

The button 52 is guided through a hole 57 in top 56 and is integral with a long thrust link 54 that extends downwardly therefrom within the confines of the vacuum cleaner 10 as bordered by a back wall 58 of the cleaner 10.

The long thrust link 54 includes an offset 60, at its bottom, which is pivoted by a loose pivot 62, formed by an integral short shaft 61, to a generally horizontally extending thinner cross link 64, the offset 60 placing the outer sides thrust link 54 and cross link 64 in general alignment and permitting thrust link 54 to be thickened along most of its length. These two links are pivoted to an intermediate wall 66 extending downward from top 56 by a pivot 68. The pivot 68 of cross link 64 is formed by an integral connector button 70 having a series of wedges 74, 74 on its opposite split end. The "wedged" end of the connector button 70 is inserted through a bore 78 in wall 66 so that the one way wedges 74, 74 captivate the connector 70 in the wall 66. The button 70 then turns with the link 64 through rotating surface 71. The pivot 68 includes a hollow 72, generally in the link 64, which serves to conserve material overall for the latching arrangement 50. A face 76 terminates the hollow at its inner side.

Intermediate the ends of the cross link 64 is a latch carrying link 80 that depends downwardly. This link is loosely pivoted to cross link 64 by pivot 82 formed by a short stub shaft 84 on the upper end of link 80 inserted a bore 86 in cross link 64. The loose pivots 62 and 84 are maintained connected by the general alignment of the arrangement 50. Below the pivot 82, the latch carrying link 80 is stepped outwardly so that a track section 88 of it can form oppositely facing channels 90 and 92 which receive wall portions 94 and 96 of intermediate wall 66 therein. An aperture 98 in an offset 99 of intermediate wall 66 permits the downward insertion therein of latch carrying link 80.

Below the track section 88, the latch carrying link 80 includes a downwardly extending portion 100 which carries a latch catch 102 on its inner side utilized for locking purposes. On its outer side, link 80 is attached with a cross piece 104 which serves as a reinforcement and an abutment check, acting against the outer wall 58, if the link 80 is distorted outwardly.

The latching arrangement 50 is spring urged upwardly by a coil tension spring 106 having hooked ends 108 and 110 that connect, respectively, through an aperture 112 in intermediate wall 66 and an aperture 114 in cross link 64. The spring 106 lays partly in cutout 116 in intermediate wall 66. A stop 115, integral with intermediate wall 66 acts against spring 106 and limits upward movement of the latching arrangement 50. A stop 117, integral with intermediate wall 66 limits downward movement.

Figure 3:
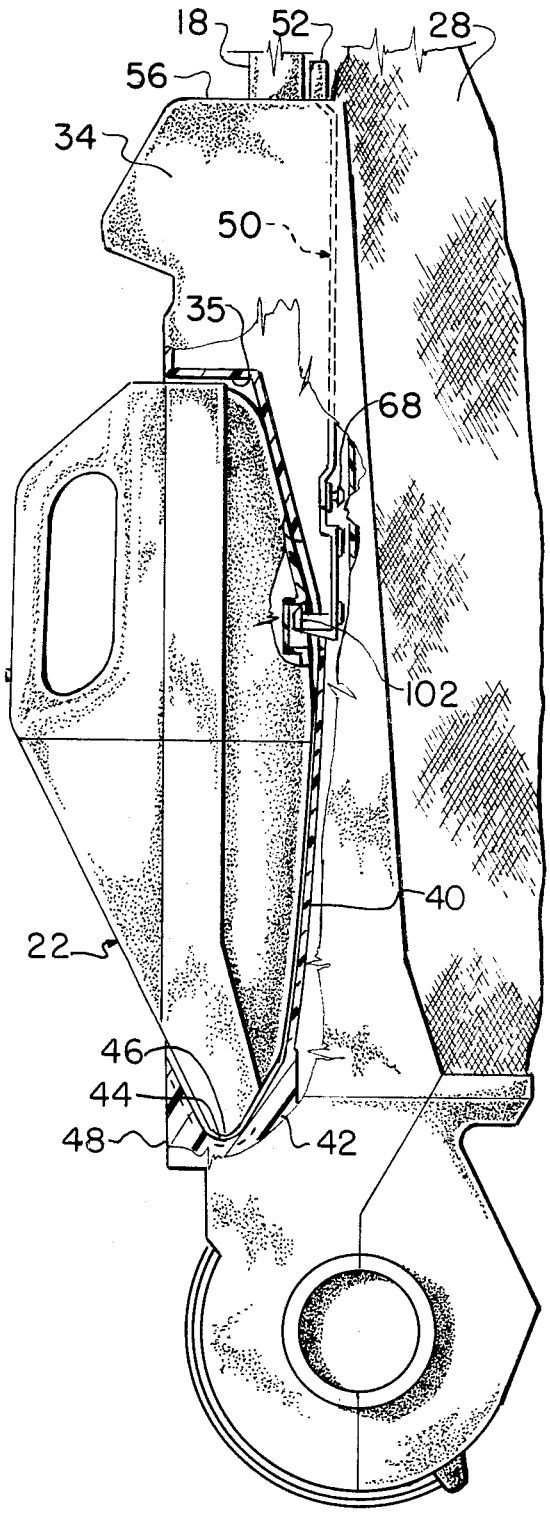
FIG. 3 is a side elevation view, partly in cross section, of the same rigid housing.

Latch catch 102 extends through a vertically extending slot 118 in intermediate wall 66 and then through a keyhole shaped slot 119 in the back wall 40 of the pocket 24 (e.g. FIG. 3), formed by the front cover 20 of upper rigid housing 14 so as to be engageable with the accessory appliance 22. Disposed within accessory appliance 22 is a latching recess 122 which is tapered from its top to form, generally, a triangle with rounded points and with an apex 124 uppermost. It includes at its top a latching lip or catch 126 that extends downwardly from the top and forms a ledge behind which latch catch 102 locks by means of a latch portion 128. The keyhole slot 119 is shaped to permit insertion of the enlarged nose 103 of latch catch 102 at its top so that the latch catch is situated to engage latching recess 122.

Figure 7:
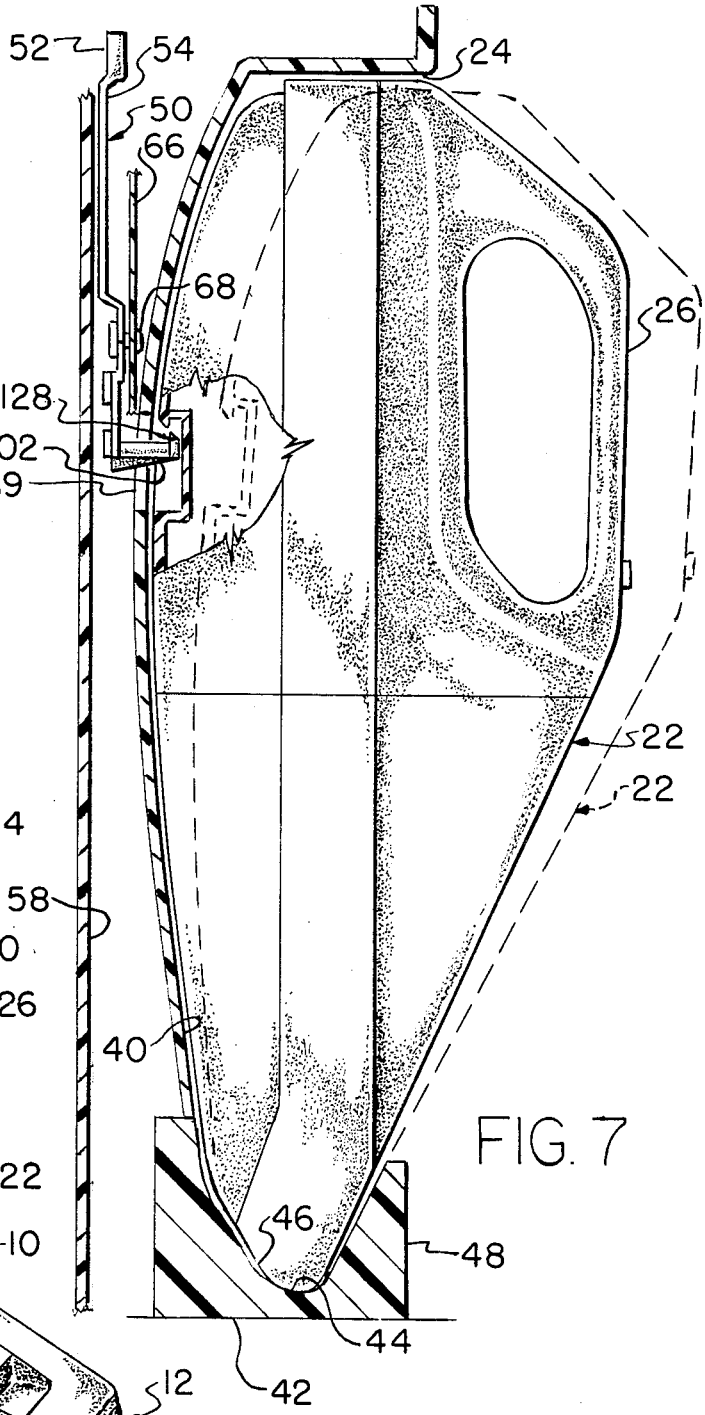
FIG. 7 is a generalized view, partly in cross section, of the accessory appliance of FIG. 1 in latched and unlatched position.
Figure 2:
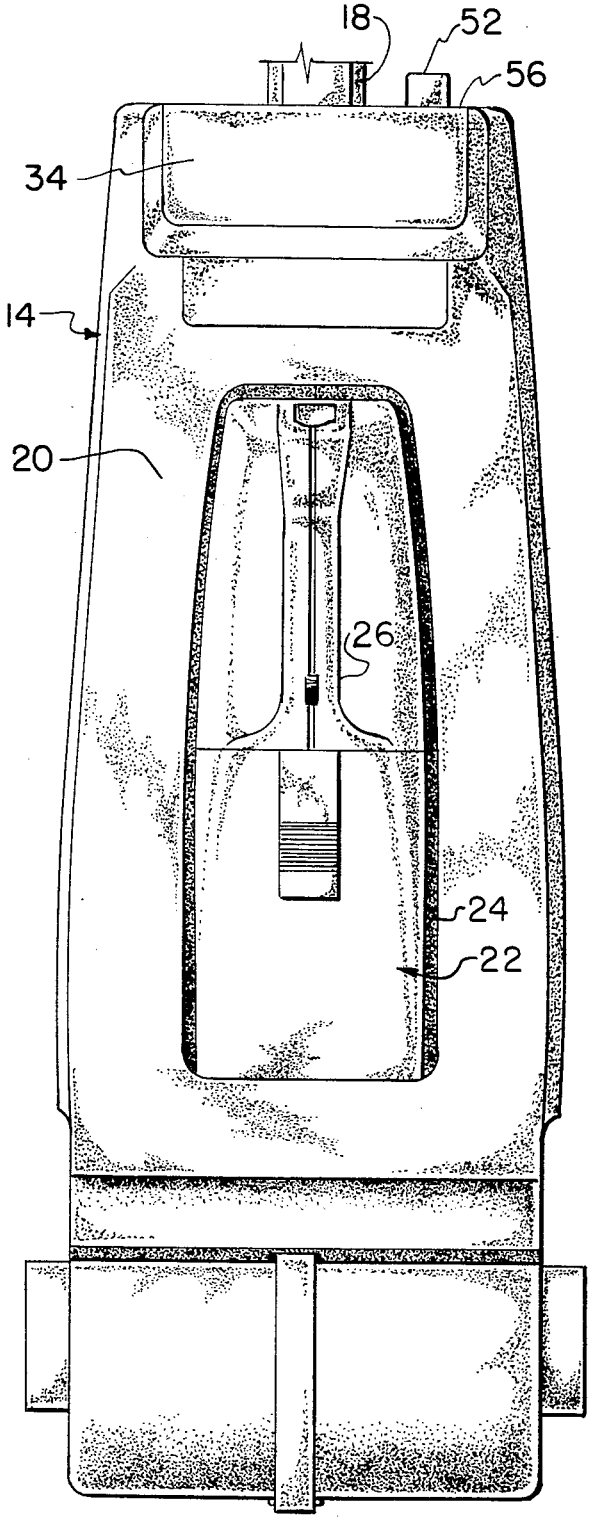
FIG. 2 is a front elevational view of the upper rigid housing of the preferred embodiment.
Figure 4:
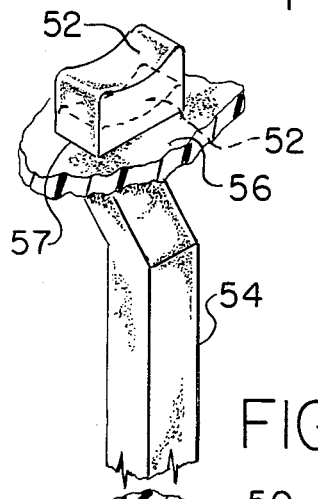
FIG. 4 is a perspective view, in latched and unlatched position, of the latching arrangement for the accessory appliance of FIG. 1.
Figure 8:
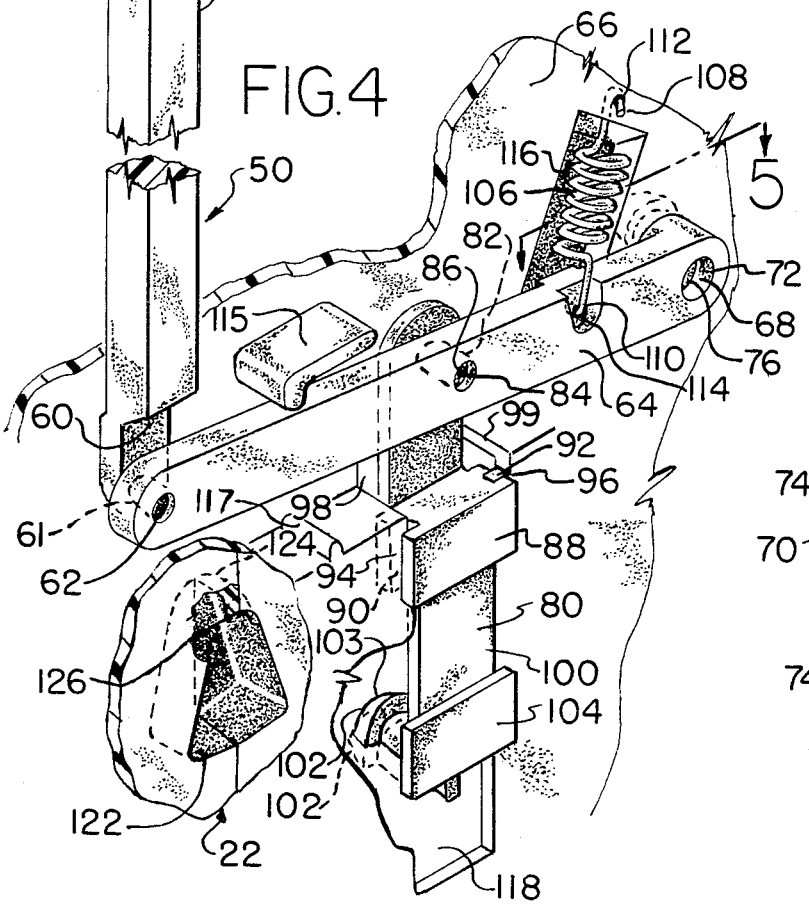
FIG. 8 is a fragmentary view of the rigid housing of FIG. 1 showing the accessory appliance pocket.
Figure 8:
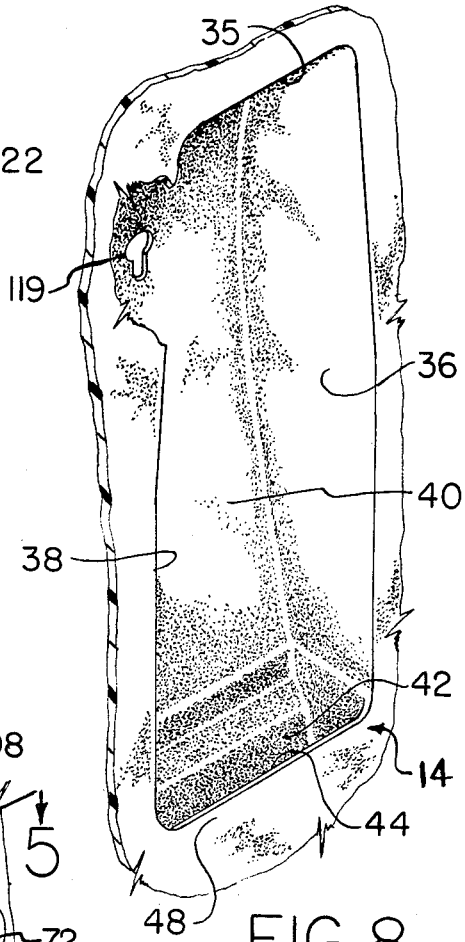
Figure 5:
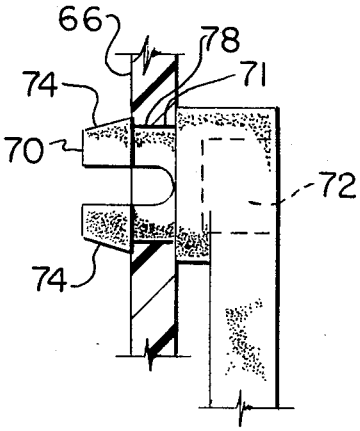
FIG. 5 is a view taken on line 5—5 of FIG. 4 and showing one end of the latching linkage with the spring removed.

The operation of the preferred embodiment should now be apparent. Assuming that the accessory appliance 22 is mounted in nested configuration with the cleaner 10, to release the accessory appliance the button 52 is depressed driving the latching arrangement 50 downwardly (dashed position in FIG. 4). This moves the latch catch 102 downwardly (FIG. 7) clearing a latch portion 128 of it from the lip 126. The accessory appliance 22 is then tilted outwardly from its top (dashed position in FIG. 7) and then removed from the lower portion of the pocket 24 upwardly to free its snout 46.

Figure 6:
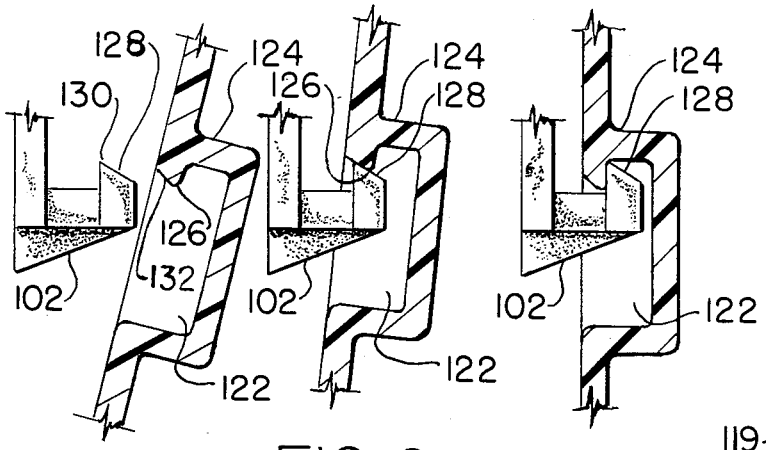
FIG. 6 is a somewhat schematic illustration of the catch of the latching arrangement of FIG. 4 in neatly engaged, engaged and disengaged position.

To nest the accessory appliance 22 in the cleaner 10, the above process is generally reversed. The snout 46 is put in the lower reaches of the pocket 24 and the accessory appliance is swung inwardly providing a camming action between the latch portion 128 and the lip 126 (FIG. 6) by camming surfaces 130 and 132, respectively, until the latching linkage 50 can move upwardly locking the accessory appliance 22 to the cleaner 10.

Figure 9:
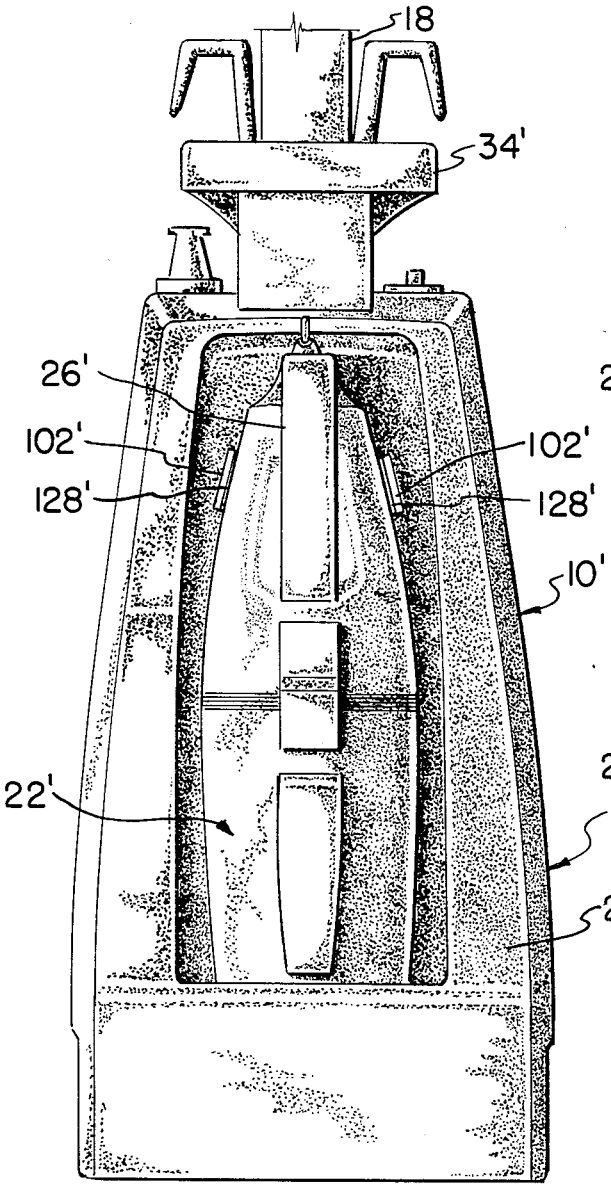
FIG. 9 is a front elevational view of a second embodiment of the invention.
Figure 10:
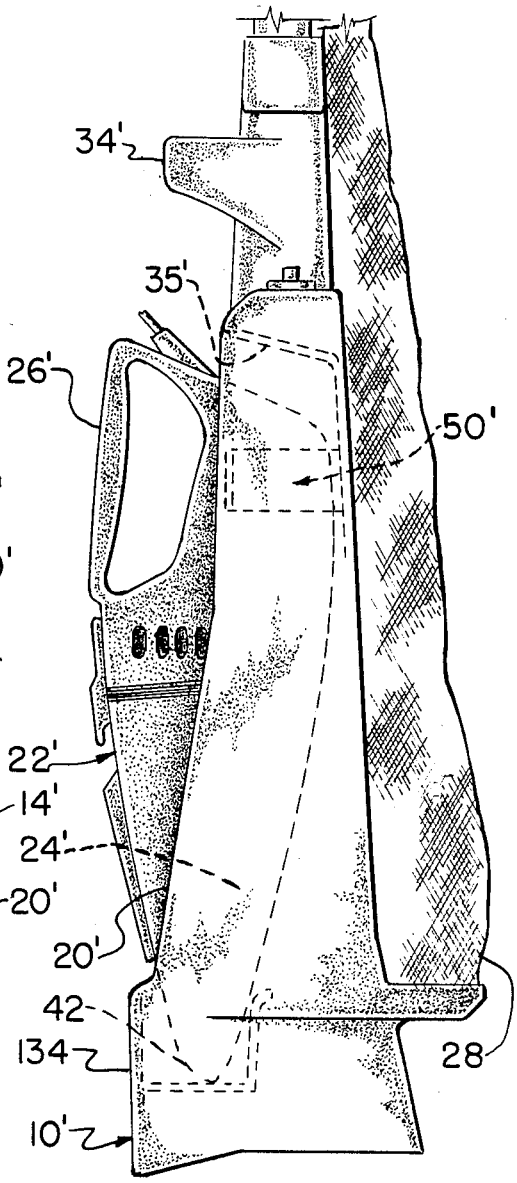
FIG. 10 is a side elevation view of the embodiment of FIG. 9.
Figure 11:
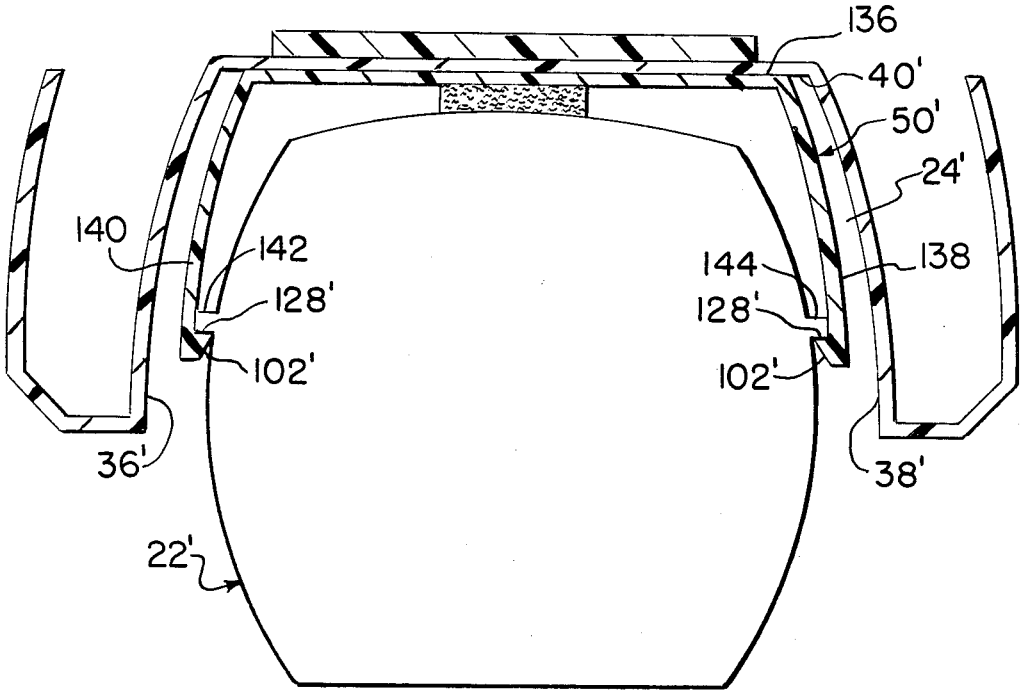
FIG. 11 is a somewhat diagrammatic view of the latch arrangement of the second embodiment.

The embodiment illustrated in FIGS. 9–11, utilizes primed numerals for similar but differing structure than that shown in the preferred embodiment.

A cleaner 10′ includes an upper rigid housing 14′ surmounted by a handle 18. A front portion 20′ houses an accessory appliance 22′ in pocket 24′. The accessory appliance 22′ includes a handle 26′ for cleaning manipulation purposes. As is conventional, the cleaner 10′ has a dirt collecting bag 28 extending upwardly along the upper rigid housing 14. A carrying handle 34′ is mounted to upper reaches of the front portion 20′.

The pocket 24′ includes top wall 35′, side walls 36′ and 38′ and a back wall 40′. The bottom of the pocket 24′ is closed by a cup shaped lower portion 42′ which includes a front wall 134. Thus, the accessory appliance 22′ is lodged in the pocket 24′, conforming generally to its outline and held in at its bottom by front wall 134.

A latching arrangement 50′ maintains the accessory appliance in the pocket 24′ at its top. It takes the form of a generally springy, U-shaped piece having a bight 136 and extending legs 138 and 140. The legs are tipped at their outer ends with hook portions forming latch catches 102′, 102′ having latch portions 128′, 128′. A pair of lip or ledge forming abutments 142, 144 are mounted with the accessory appliance 22′ around which latch portions 128′, 128′ engage.

It should be obvious that the accessory appliance 22′ is easily placed in or removed from the pocket by forcing the latching arrangement 50′ to cammingly accept reception it or by springing the latch catches 102′, 102′ outwardly for removal of the accessory appliance 22′.

It should be clear from the foregoing that the objects of the invention have been fully met. Further, many modifications to the structure described could be made easily by one skilled in the art which would still fall within the spirit and purview of the description offered.

What is claimed is:

1. An upright vacuum cleaner including an upwardly extending rigid housing, said rigid housing having a bottom pivoted to a lower rigid housing serving as a nozzle:

a handle extending upwardly from said upwardly extending rigid housing and having lower reaches, said lower reaches attached to said upwardly extending rigid housing, said upwardly extending rigid housing having a recess formed in it intermediate its height, said recess adapted for the receipt of a cleaning appliance or the like for transport of said cleaning appliance with said upright cleaner.

2. The combination comprising an upright electric suction cleaner together with an auxiliary electric suction cleaner:

said upright cleaner having a lower portion for engagement with a floor surface and a handle pivotally connected to said lower portion for manipulating the latter over said floor surface, a rigid housing between said upright cleaner lower portion and said handle, said housing having a recess adapted to removably receive said auxiliary cleaner, and said recess facing in a forward direction when said handle is in an upright storage position to facilitate removal of said auxiliary cleaner from and replacement thereof in said recess.

3. The construction of claim 2 wherein latch means is disposed within said recess for releasably retaining said auxiliary cleaner therein.

4. A floor care appliance including;

(a) a lower rigid housing serving as a suction nozzle for said floor care appliance, (b) an upper rigid housing pivoted to said lower rigid housing and extending upwardly therefrom to mount a first handle, (c) said lower rigid housing extending forwardly in an operational sense from said upper rigid housing, (d) said first handle extending upwardly from said upper rigid housing, (e) a front portion of said upper rigid housing facing forwardly relative to the forward extension of said lower rigid housing, (f) a recess formed in said front portion of said upper rigid housing for the reception, storage and transport of an accessory appliance.

5. The floor care appliance of claim 4 wherein;

(a) a means for latching said accessory appliance with said floor care appliance is disposed at least partly in said recess.

6. The floor care appliance of claim 4 wherein;

(a) a second handle is mounted with said upper rigid housing to extend transverse to said first handle for transport of said floor care appliance.

7. The floor care appliance of claim 4 wherein;

(a) a dirt collecting bag is disposed behind said front portion of said upper rigid housing.

* * * * *